US006810603B1

(12) United States Patent
Cosentino

(10) Patent No.: US 6,810,603 B1
(45) Date of Patent: Nov. 2, 2004

(54) TOE PAD FOR BALLET DANCERS

(76) Inventor: Anthony Cosentino, 21 Burford Dr., Commack, NY (US) 11725

( * ) Notice: Subject to any disclaimer, the term of this patent is extended or adjusted under 35 U.S.C. 154(b) by 0 days.

(21) Appl. No.: 10/656,412

(22) Filed: Sep. 5, 2003

Related U.S. Application Data

(63) Continuation of application No. 09/832,060, filed on Apr. 10, 2001, now abandoned.

(51) Int. Cl.[7] ..... A43B 5/12
(52) U.S. Cl. ..... 36/8.3; 36/96
(58) Field of Search ..... 36/8.3, 96, 71

(56) References Cited

U.S. PATENT DOCUMENTS

| | | | | | |
|---|---|---|---|---|---|
| 1,744,122 | A | * | 1/1930 | Keeling | 36/8.3 |
| 2,810,214 | A | * | 10/1957 | Wolfe | 36/8.3 |
| 3,449,844 | A | | 6/1969 | Spence | |
| 4,292,263 | A | | 9/1981 | Hanrahan et al. | |
| 5,098,421 | A | | 3/1992 | Zook | |
| 5,111,597 | A | * | 5/1992 | Hansen et al. | 36/8.3 |
| 5,262,468 | A | | 11/1993 | Chen | |
| 5,469,641 | A | | 11/1995 | Subotic | |
| 5,497,789 | A | | 3/1996 | Zook | |
| D420,784 | S | | 2/2000 | Riecken | |
| 6,308,337 | B1 | | 10/2001 | Penley | |
| 6,705,026 | B1 | * | 3/2004 | Arbour | 36/8.3 |
| 2001/0045028 | A1 | | 11/2001 | Crane et al. | |
| 2003/0033729 | A1 | * | 2/2003 | Farrior | 36/8.3 |

* cited by examiner

*Primary Examiner*—Ted Kavanaugh
(74) *Attorney, Agent, or Firm*—Fattibene & Fattibene; Paul A. Fattibene; Arthur T. Fattibene

(57) ABSTRACT

A reversible toe pad used by dancers comprising a pad material and a bonded seamless fabric material. A fabric is bonded to the surface of a padding material on one side so as to form a reversible toe pad. The toe pad may be reversed so that the padding material is placed adjacent the dancer's toes or the fabric material is placed adjacent the dancer's toes, depending upon the dancer's preference. The padding material may be a gel or foam. A molding process utilizing a female mold and a male mold may be used.

3 Claims, 2 Drawing Sheets

TOE PAD FOR BALLET DANCERS

RELATED APPLICATION

This application is a continuation of application Ser. No. 09/832,060 filed Apr. 10, 2001 now abandoned.

FIELD OF THE INVENTION

The present invention relates in general to a toe pad used in ballet, and more particularly to a composite gel and fabric material bonded together for use as a ballet toe pad.

BACKGROUND OF THE INVENTION

In ballet, it is often necessary for a ballerina or dancer to go en pointe or stand on their toes. Historically, many different devices have been used on the dancer's feet and in shoes to render going en pointe more comfortable. Ballerinas often use various types of toe pads, with each ballerina having their particular preference. Generally, toe pads are designed to cover all five toes and are placed on the foot and then inserted into pointe shoes. Toe pads have been made of various materials to absorb some of the forces that are encountered and to provide a more comfortable fit. Some toe pads are made of a synthetic or lamb's wool material. Other toe pads have been made of a gel material. Still other toe pads have been made of a gel material covered completely with a seamed fabric material. A specially constructed ballet shoe is disclosed in U.S. Pat. No. 5,469,641 entitled "Custom Ballet Pointe Shoe" issuing to Subotic on Nov. 28, 1995. Therein disclosed is a ballet pointe shoe having a toe sock and another layer attached together forming a cavity. An injection tube infiltrates the cavity permitting an injected filling product to be placed within the cavity. The filling product then hardens or cures, taking the permanent shape of the dancer's foot.

While these prior toe pads have been generally effective, they are either too simple and limited or too complex. Many ballet dancers often use several different types of toe pads. Accordingly, there is a need for an improved toe pad in which dancers can be provided with a choice in a single pad that has the advantages of either a gel pad or fabric pad in a simple, easy to use form.

SUMMARY OF THE INVENTION

The present invention comprises a ballet pointe shoe toe pad that is reversible to provide either a gel surface or a fabric surface adjacent to the users toes. The toe pad of the present invention comprises a cup shaped toe pad having a gel layer and a fabric layer bonded thereto. The toe pad is reversible in that the fabric layer may be placed adjacent the toes on the inside of the toe pad or placed inside out or reversed so that the gel layer is placed adjacent the toes. The fabric layer is made from a seamless stretchable material.

The present invention also encompasses a method of making the toe pad comprising the use of a male and female mold to assure bonding of the gel material and fabric material.

It is an object of the present invention to provide a comfortable toe pad to be used by ballet dancers.

It is a further object of the present invention to provide the ballerina dancer with a choice of toe pad materials in a single toe pad.

It is an advantage of the present invention that it is reversible.

It is a feature of the present invention that a seamless fabric is used, providing additional comfort.

It is another feature of the present invention that the gel is bonded to the seamless fabric.

These and other objects, advantages and features will become readily apparent in view of the following more detailed description.

DETAILED DESCRIPTION OF THE PREFERRED EMBODIMENTS

Figure 1:
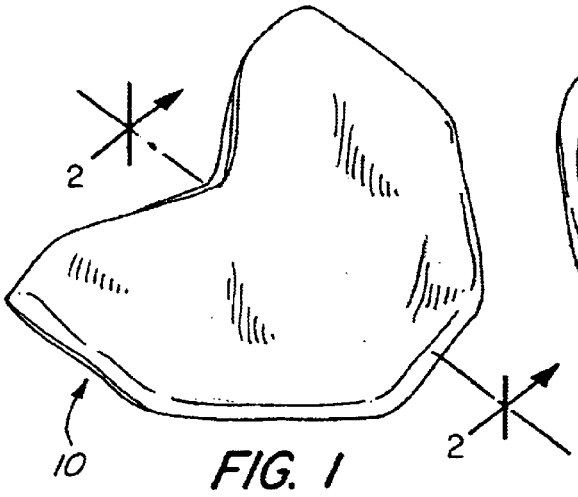
FIG. 1 is a plan view illustrating a toe pad of the present invention.
Figure 2:
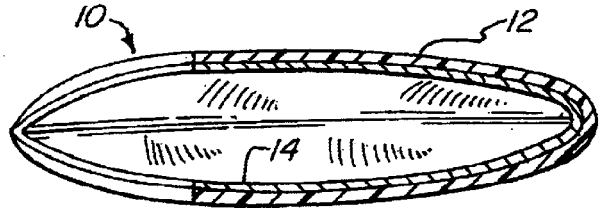
FIG. 2 is a cross section taken along line 2—2 in FIG. 1.

FIG. 1 illustrates the toe pad of the present invention. FIG. 2 is a cross section taken along lines 2—2 in FIG. 1. FIG. 2 more clearly illustrates the construction of the toe pad according to the present invention. A pad or gel material 12 is placed on a fabric material 14. The gel material may be made of a thermoplastic elastomer such as the gelatinous composition disclosed in U.S. Pat. No. 5,262,468 entitled "Thermoplastic Elastomer Gelatinous Compositions" issuing to Chen on Nov. 16, 1993, which is herein incorporated by reference. The pad material may also be a foam type material, or any equivalent padding material that can be bonded to the fabric material 14. The fabric material 14 is preferably a knitted seamless fabric made of nylon, cotton, spandex or equivalent material. The fabric material 14 may be made of a natural material or a synthetic material. The knitted seamless fabric preferably can stretch in different directions together with the gel material. The gel material is bonded to the fabric 14. The knitted seamless fabric material 14 prevents a seam being placed at the distal end of the toe pad. Conventional toe pads often also have a side seam and are relatively uncomfortable to the dancer, as the toes are pressed with considerable force on the seams when dancing en pointe.

Figure 3:
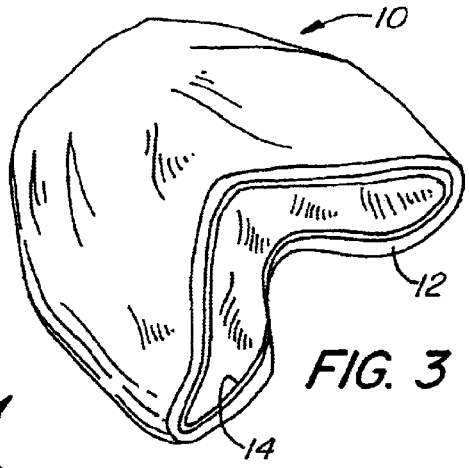
FIG. 3 is a perspective view illustrating the toe pad with a gel material on the outside surface.

FIG. 3 illustrates the present invention having the pad or gel material 12 placed on the exterior surface of the toe pad 10. The seamless knitted fabric material 14 is placed on the interior surface of the toe pad 10. Therefore, dancers that desire to have the fabric adjacent their toes are accommodated. The pad or gel material 12 can be made of different thicknesses to provide different degrees of cushioning. Additionally, the pad or gel material 12 may be made of other padding material such as a foam material.

Figure 4:
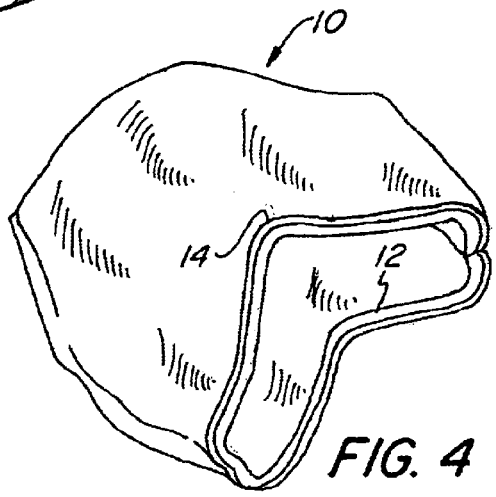
FIG. 4 is a perspective view of the toe pad reversed having the gel material placed on the interior or inside surface.

FIG. 4 illustrates the present invention reversed or turned inside out so that the fabric material 14 is placed on the exterior surface of the toe pad 10 and the pad or gel material 12 is placed on the inside surface of the toe pad 10. This is to accommodate dancers who prefer the gel to be placed adjacent the toes.

Figure 5:
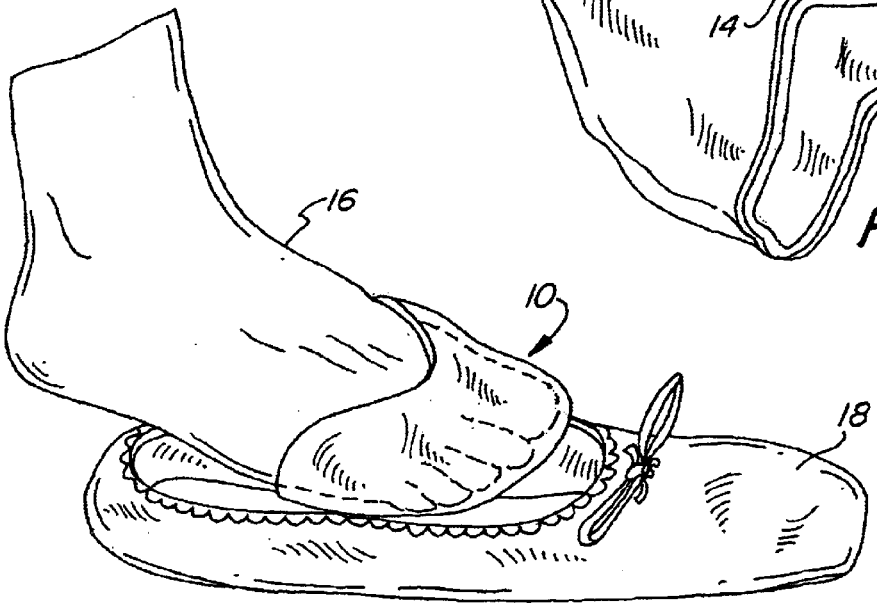
FIG. 5 illustrates the placement of the toe pad of the present invention on a dancer's foot.

FIG. 5 illustrates the application of the present invention of a toe pad 10. The toe pad 10 is placed on a dancers foot 16 encircling all five toes. Preferably, the toe pad 10 extends up the sides of a dancer's foot slightly. The ballet pointe shoe 18 is then placed over the dancer's foot 16. The user or dancer can easily remove the toe pad 10 and reverse it so that either the pad or gel material 12 is contacting the dancer's toes or the fabric material 14 is contacting the dancer's toes. This permits the user or dancer to have a choice as to the type of toe pad material used adjacent the dancer's toes.

Figure 6:
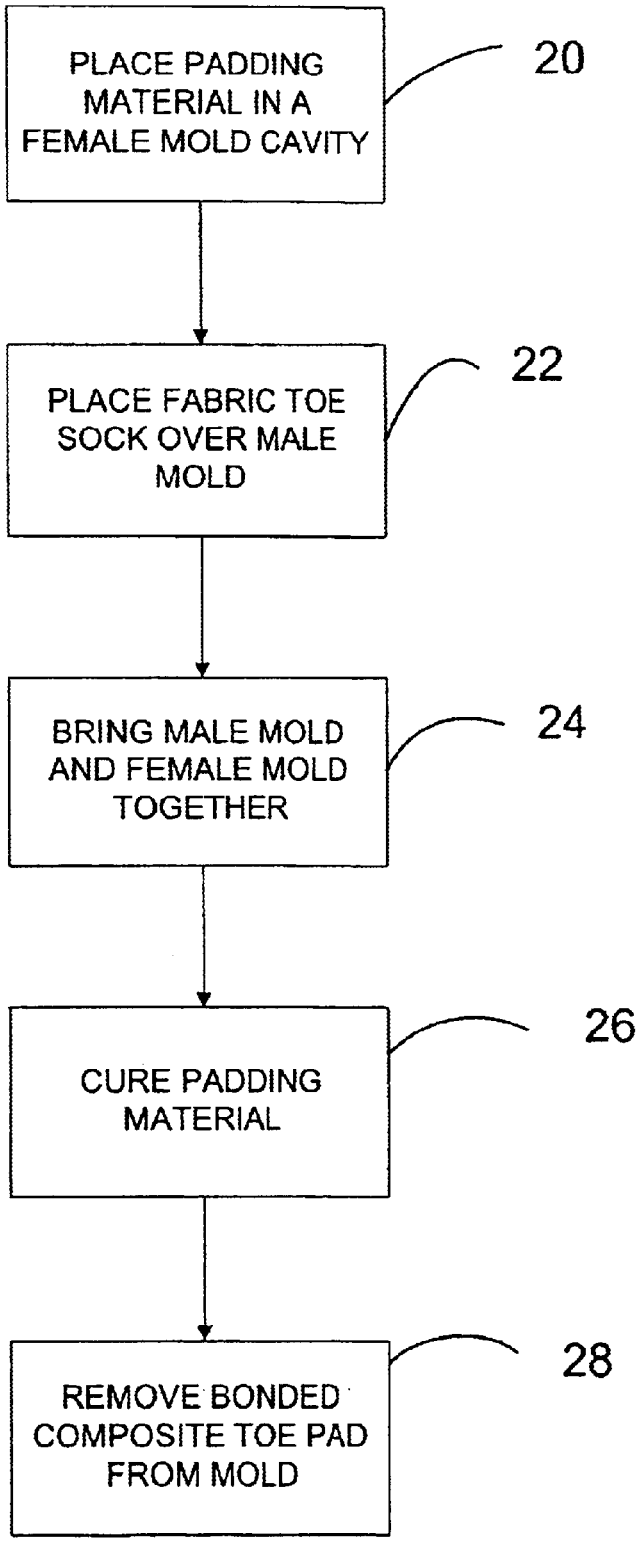
FIG. 6 illustrates the method steps of making the toe pad according to the present invention.

FIG. 6 is a block diagram illustrating the method steps or acts according to the present invention utilized in manufacturing toe pads. Box 20 represents the step of placing a padding or gel material in a female mold cavity. Box 22 represents the step of placing a fabric toe sock over a male mold. The pad or gel material placed in the female mold may be a liquid plastisol material or a vinyl resin dissolved in a plasticizer to make a pourable liquid. The padding material may also be in the form of a sheet of gel or foam material. Box 24 represents the step or act of bringing the male mold and female mold together. Box 26 represents the step of curing the padding or gel material so that the fabric material contacts the padding or gel material. The curing of the padding or gel material effectively bonds the fabric to the padding or gel. Box 28 represents the method step or act of removing the bonded composite toe pad from the mold. If desired, the toe pad may be die cut to a desired shape or further trimmed to desired shape.

If a liquid plastisol material is utilized in the step represented by Box 20 of placing the gel material in a female mold cavity, then a measured amount of the liquid plastisol material is dispensed into the female mold cavity. The knitted seamless fabric toe sock is then attached over the male mold. The liquid plastisol material may be cured by any conventional curing technique, such as by heat or the use of a high frequency molding machine. In a high frequency molding machine, high frequency energy is used for a specific amount of time to cure the liquid plastisol material. The desired thickness of the liquid plastisol material when cured is determined by the difference in size of the male mold cavity and the female mold cavity, and the amount of liquid material placed within the mold. After cooling, the mold is opened and a toe pad may be removed from the male mold.

A sheet of padding material, such as foam or gel, may also be utilized in bonding to the knitted fabric material. A sheet of padding material of the desired thickness may be placed in the female mold cavity. The knitted seamless fabric or sock is then placed over the male mold. The female mold and male mold are brought together. The padding material is bonded to the fabric material chemically, thermally, ultrasonically, or by any other well known equivalent technique for bonding materials. The thickness of the toe pad is controlled by the thickness of the sheet of foam material. Once cooled, the mold is open and the toe pad is removed. The toe pad may be die cut to the required or desired size.

The fabric preferably used with the padding material is a knitted seamless fabric made into the toe portion of a sock knitted to a length of about four inches. The toe sock may be made on a circular knit multi-needle hosiery machine so as to create a seamless toe sock. This prevents the need of the operator to sew the toe area closed. Many different types of yarns or blends of yarns may be utilized to provide a toe sock, depending upon the properties required. For example, nylon, polyester, spandex, or other equivalent stretchable material may be used.

The present invention, while being relatively simple, greatly advances the comfort of a dancer. Additionally, the present invention, in providing a reversible toe pad, permits dancers to choose whether or not to use a fabric material adjacent their toes or a gel material adjacent their toes. Additionally, the dancer may change the material adjacent the dancer's toes at will without the need to purchase additional or different toe pads. The toe pad also, being made from a fabric material that is seamless, prevents a seam from pressing on the dancer's foot.

Although the preferred embodiment has been illustrated and described, it will be obvious to those skilled in the art that various modifications may be made without departing from the spirit and scope of this invention.

What is claimed is:

1. A method of padding a ballet dancer's toes, which comprises the step of placing thereon a reversible toe pad comprising:

a stretchable seamless knitted fabric material having a closed end and extending sides adjacent an open end adapted to be placed over a ballet dancer's toes; and a gel padding material adhered to one entire surface of said stretchable seamless knitted fabric material, the reversible toe pad adapted to be turned inside out such that said gel padding material or said stretchable seamless knitted fabric is capable of being selectively placed adjacent the ballet dancer's toes.

2. A method of padding a ballet dancer's toes comprising the steps of:

placing a reversible toe pad having one side made of a stretchable seamless knitted fabric and another side made of a gel padding material on the ballet dancer's toes with the stretchable seamless knitted fabric placed inside contacting the ballet dancer's toes;

removing the reversible toe pad form the ballet dancer's toes;

turning the reversible toe pad inside out so that the seamless knitted fabric is placed outside; and replacing the reversible toe pad on the ballet dancer's toes with the gel padding material placed inside contacting the dancer's toes, whereby the ballet dancer is capable of selecting either the seamless knitted fabric or the gel padding material to contact the ballet dancer's toes.

3. A method of padding a ballet dancer's toes comprising the steps of:

providing the ballet dancer with a reversible toe pad having one side made of a stretchable seamless knitted fabric and another side made of a gel padding material;

instructing the ballet dancer to selectively place either the stretchable seamless knitted fabric or the gel padding material adjacent the ballet dancer's toes by turning the reversible toe pad inside out, whereby the ballet dancer is capable of selecting either the seamless knitted fabric or the gel padding material to contact the ballet dancer's toes.

* * * * *